United States Patent [19]

Walters

[11] 3,999,639

[45] Dec. 28, 1976

[54] LUGGAGE WITH PERSONALIZED IDENTIFICATION MEANS

[75] Inventor: William W. Walters, Trinity, N.C.

[73] Assignee: San-Jan, Inc., High Point, N.C.

[22] Filed: Mar. 23, 1976

[21] Appl. No.: 669,603

[52] U.S. Cl. ..... 190/60; 40/2 R; 150/7; 190/52

[51] Int. Cl.[2] ..... A45C 13/42

[58] Field of Search ..... 40/2 R, 5, 6; 190/41 B, 190/43, 52, 60; 150/7, 42

[56] References Cited

UNITED STATES PATENTS

| | | | |
|---|---|---|---|
| 1,277,785 | 9/1918 | Urband | 190/60 |
| 1,490,630 | 4/1924 | Nesser | 190/60 UX |
| 3,244,261 | 4/1966 | Herz | 190/43 |
| 3,557,853 | 1/1971 | Jones | 150/7 |
| 3,640,008 | 2/1972 | Crail | 40/2 R |

*Primary Examiner*—Donald F. Norton
*Attorney, Agent, or Firm*—Mason, Fenwick & Lawrence

[57] ABSTRACT

A garment bag has a front panel having a pocket opening with a flap overlying the opening and having a Velcro fastener on its inner surface with a second Velcro fastener attached to the front panel a distance below the pocket opening; an identification tab has Velcro fasteners engageable with the fasteners on the pocket flap and the front panel of the bag to be retained on the bag and close the pocket but which is removable to permit the application of desired monogramming or the like.

12 Claims, 4 Drawing Figures

Fig-1
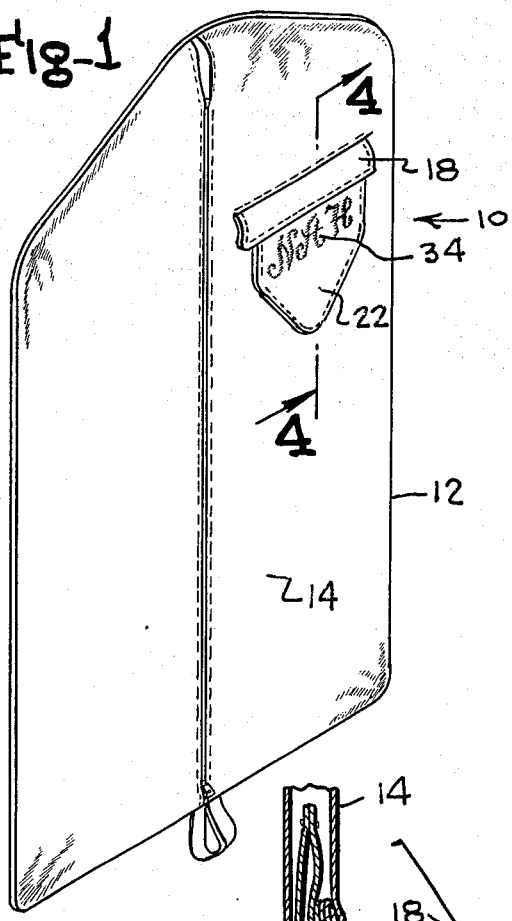
Fig-2
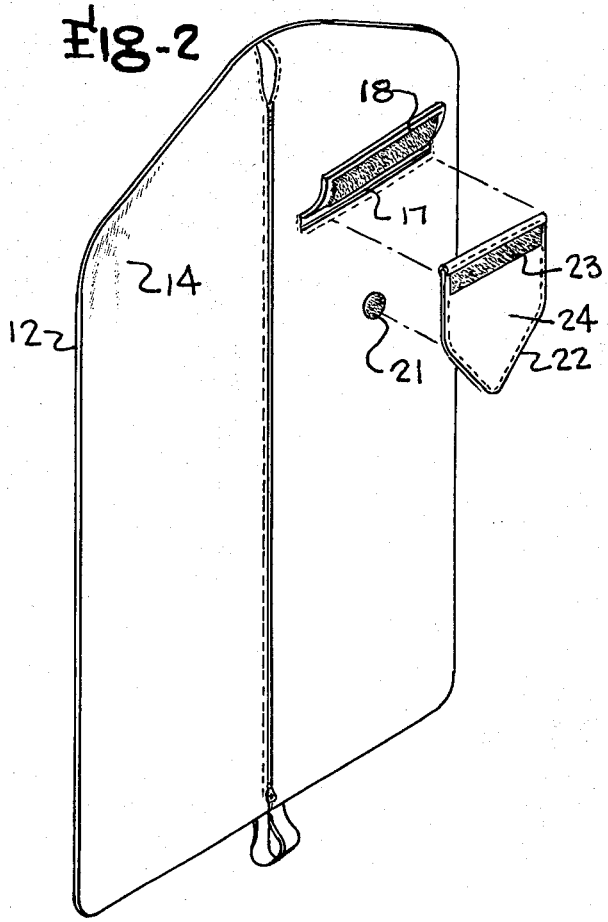
Fig-4
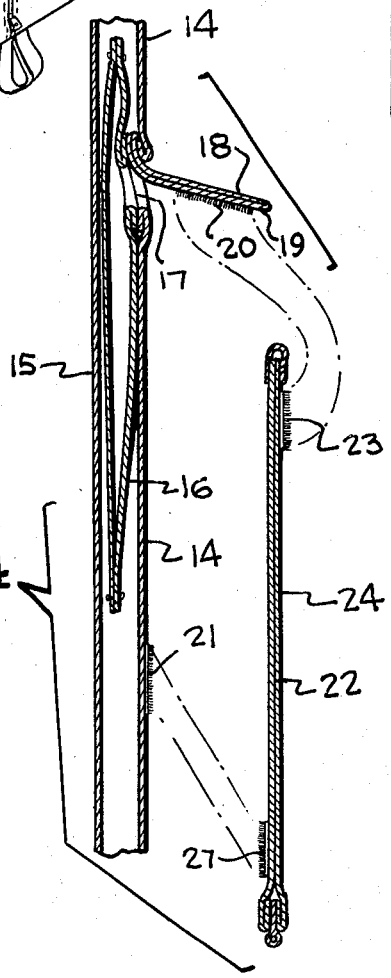
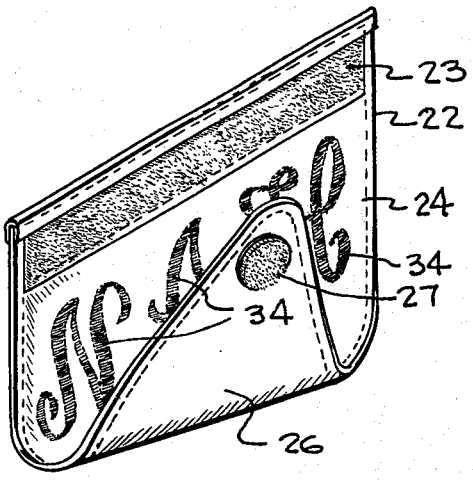
Fig-3

LUGGAGE WITH PERSONALIZED IDENTIFICATION MEANS

This invention is in the field of identification enabling means and is more specifically directed to the field of luggage and associated means for applying identification to same.

It has been a long-standing practice to apply name tags to luggage such as suitcases, garment bags and the like with such name tags frequently including a buckle and strap to which a card holder or the like bearing the owner's name and address is affixed with the buckle or strap being connected around the handle of the item. The conventional name tag is quite small and cannot be read so as to permit an accurate identification of luggage without close inspection. The fact that many items of luggage are similar or are identical in appearance creates a substantial inconvenience in ascertaining the identity of luggage on many occasions requiring a close inspection of each piece of luggage including the reading of the name tag for that purpose. Such a process can obviously be extremely inconvenient in crowded public facilities such as airports, train stations and similar facilities.

One previous approach to making luggage more readily identifiable has been to apply a name or monogram to the item of luggage itself by means of adhesion, sewing or similar conventional procedures; however, these procedures have not been satisfactory for a number of reasons with the primary drawback being that it is necessary to leave the entire item of luggage with an artisan for the purpose of having the indicia applied. This fact creates the possibility of loss of the item due to theft or irreversible damage to the entire item because of mistaken application of unremovable erroneous indicia such as improper initials.

A primary drawback of present luggage identification procedures arises from the fact that most people do not have the artistic ability to provide a satisfactory application of indicia to luggage and must consequently turn to skilled craftsmen in the field in order to obtain an attractive and useful personally monogrammed product. Another drawback resides in the fact that it is desirable that such identification applied to an item of luggage be applied to all such items of a luggage set with the consequent expense resultant therefrom.

Therefore, it is the primary object of this invention to provide a new and improved means of effecting the application of personalized identifying indicia to luggage.

Yet another object of the invention is the provision of a new and improved means for enabling the application of relatively large items of indicia to luggage by the use of skilled craftsmen without it being necessary for the craftsmen to work directly on the item of luggage.

A still further object of the invention is the provision of means for enabling the interchangeability of luggage identification indicia with a minimum of difficulty.

Achievement of the foregoing objects is enabled by the preferred embodiment of the invention which consists of an item of luggage, such as a suit bag, which has a pocket over which an overlying flap is provided on its outer surface. The underside of the flap is provided with a Velcro pressure engageable fastener surface which is engageable with a similar surface on the outer face of a large removable identification tab overlying the pocket.

The removable identification tab can be easily connected to the underside of the pocket flap since the portion of the outer face of the tab having the Velcro pressure engageable fastener underlies the pocket flap. However, the identification tab is disconnectible from the pocket flap to receive an identifying monogram and for other purposes such as to permit attachment to other similar items of luggage.

Upon purchase of the item of luggage, which comes as a unit including the identification tab, the purchaser returns the identification tab to the manufacturer of the item with instructions for the application of a particular indicia to the tab. Moreover, the purchaser can alternatively select a craftsman of his own choosing to whom the tab is submitted for the application of desired indicia. In either event, it is not necessary for the purchaser to relinquish control and use of the item of luggage while the desired indicia is being applied to the tab and the purchaser consequently has the benefit of using the luggage during this time. Moreover, upon return of the completed tab bearing the desired indicia, the tab is easily affixed to the item of luggage, or to other similar items of luggage so as to give the appearance of being custom made for use in conjunction with the particular item of luggage.

Moreover, the tab is of sufficient size as to permit the application of large identifying indicia such as initials or the like which can be read from a substantial distance to permit the identification of luggage when it is associated with other similar luggage items.

A better understanding of the subject invention will be achieved when the following written description is considered in conjunction with the attached drawings in which:

FIG. 1 is a perspective view of the preferred embodiment of the invention in the form of a garment bag having the identification tab attached thereto;

FIG. 2 is a perspective view similar to FIG. 1 illustrating the identification tab detached from the garment bag;

FIG. 3 is an enlarged perspective view of the identification tab illustrating the means for affixing same to the garment bag; and FIG. 4 is a sectional view taken along lines 4—4 of FIG. 1 and showing the parts in separated condition.

Attention is initially invited to FIG. 1 in which it should be noted that the preferred embodiment of the invention, generally designated 10, comprises a garment bag 12 formed of flexible material such as cloth or other woven material, plastic, leather or the like the type commonly used for receiving hanger supported items of clothing such as suits, dresses, shirts and similar items.

Bag 12 has a front panel 14 and a rear panel 15 (FIG. 4) with a pocket 16 having an opening 17 being formed in the front panel 14 and covered by a pocket flap 18. Pocket flap 18 has an underside surface 19 along which a first Velcro press-type fastener component 20 is attached as best illustrated in FIG. 2. A second Velcro press-type fastener component 21 is provided on front panel 14 spaced below the pocket opening 17 as shown in FIG. 2.

A removable identification tab 22 is connectible to the second Velcro press-type fastener 21 on the underside of pocket flap 18 by means of a third Velcro press-type fastener component 23 attached to the front face 24 of identification tab 22. Similarly, a fourth Velcro press-type fastener component 27 is attached to the lower end portion of the inner face 26 of the identification tab member 22. The first Velcro press-type fastener component 21 and the third Velcro press-type fastener component 23 are of matable nature so as to be detachably connectible to each other and the second Velcro press-type fastener 21 and the fourth Velcro press-type fastener 27 are similarly of matable nature so as to permit the identification tab 22 to be connected to the garment bag as shown in FIG. 1.

It will be appreciated that the blank identification tab 22 illustrated in FIG. 2 can be removed from the garment bag for the purpose of having desired indicia such as shown at 34 in FIG. 1 applied thereto. It will be noted that the absence of the identification tab from the garment bag does not in any way inhibit continued usage of the bag.

Upon completion of the application of indicia to the identification tab 22, the upper end of the tab can easily be reconnected to the bag by pressing the press-type fastener elements 20 and 23 together with the lower end of the tab being connected to the bag by pressing the press-type fastener elements 21 and 25 together. Positioning of the identification tab on the bag in the foregoing manner provides a firm closure of the pocket to prevent the loss of any items in the pocket 18. In addition, the connection of the tab to the bag at two locations greatly reduces the chances that the identification tab will be accidentally removed from the bag during handling.

Consequently, it will be appreciated that the subject invention provides an easy and convenient means for permitting the application of desired indicia to luggage which is also of great versatility in that the identification tab 22 can be interchangeably used with other similar items of luggage.

Numerous modifications of the subject invention will undoubtedly occur to those of skill in the art; for example, the invention is not limited to usage with garment bags and can be used with other types of luggage as desired. The term "luggage" as used in the specification and claims is broadly used to include garment bags, suitcases, duffel bags, tennis bags, handbags and the like. Similarly, it is not essential that a pocket be provided beneath flap 18. Therefore, it should be understood that the spirit and scope of the invention is to be limited solely by the appended claims.

I claim:

1. An item of luggage having a panel with an external surface, a pocket opening in said external surface of said panel, a flap overlying said pocket opening, said flap having an underside surface and an outside surface, a press-type fastener component mounted on said underside surface, a tab member of a width approximately equal the width of said pocket opening and having a front face and a rear face, a press-type fastener component mounted on said front face of said tab member, said press-type fastener component on the underside surface of the flap and said press-type fastener component on the front face of the tab member being of matable nature so as to be connectible each to the other to permit said tab member to be removably attached to the underside of said flap so that said tab can be easily detached from said item of luggage for the purpose of having desired indicia applied thereto without the user losing the use of the item of luggage.

2. The invention of claim 1 wherein said item of luggage and said tab are formed of cloth.

3. The invention of claim 1 wherein said item of luggage and said tab are formed of identical woven materials.

4. The invention of claim 1 wherein said press-type fastener components comprise Velcro fasteners.

5. The invention of claim 1 additionally including matingly connectible press-type fastener means respectively mounted on said panel spaced below said pocket opening and on a lower portion of said rear face of said tab for permitting connection of the bottom portion of the tab to said front panel.

6. The invention of claim 5 wherein said item of luggage is a garment bag.

7. The invention of claim 5 wherein said item of luggage and said tab are formed of cloth.

8. The invention of claim 5 wherein said press-type fastener components comprise Velcro fasteners.

9. An item of luggage having a panel with an external surface, a flap connected to said external surface of said panel and having an underside surface and an outside surface, a press-type fastener component mounted on said underside surface, a tab member having a front face and a rear face, a press-type fastener component mounted on said front face of said tab member, said press-type fastener component mounted on the underside surface of said flap and said press-type fastener component mounted on the front face of the tab member being of matable nature so as to be connectible each to the other to permit the upper end of said tab member to be removably attached to the underside of said flap and matingly connectible press-type fastener means respectively attached to said panel and a lower portion of the rear face of said tab means so that said tab can be easily attached to said item of luggage at the upper and lower portions of said tab but is removable as desired.

10. The invention of claim 9 wherein said press-type fastener components comprise Velcro fasteners.

11. Identification means comprising a support means having an external surface, a flap connected to said external surface of said support, said flap having an underside surface and an outside surface, a press-type fastener component mounted on said underside surface, a tab member having a front face and a rear face, a press-type fastener component mounted on said front face of said tab member, said press-type fastener component mounted on the underside surface of said flap and said press-type fastener component mounted on the front face of the tab member being of matable nature so as to be connectible each to the other to permit the upper end of said tab member to be removably attached to the underside of said flap and first and second matingly connectible press-type fastener component means respectively attached to said support means and a lower portion of the rear face of said tab means so that said tab can be easily attached to said support means at the upper and lower portions of said tab but is selectively removable as desired.

12. The invention of claim 11 wherein said press-type fastener components comprise Velcro fasteners.

* * * * *